US005501806A

United States Patent [19]

Farooq et al.

[11] Patent Number: 5,501,806

[45] Date of Patent: Mar. 26, 1996

[54] CONCENTRATED LIQUID FABRIC SOFTENING COMPOSITION

[75] Inventors: Amjad Farooq, Somerset, N.J.; Regis Cesar, Villers-le-Bouillet; Francoise Deville, Liege, both of Belgium

[73] Assignee: Colgate-Palmolive Co., New York, N.Y.

[21] Appl. No.: 213,308

[22] Filed: Mar. 14, 1994

Related U.S. Application Data

[63] Continuation-in-part of Ser. No. 92,186, Jul. 15, 1993, abandoned.

[51] Int. Cl.[6] ..... D06M 13/10; D06M 13/325

[52] U.S. Cl. ..... 252/8.8; 252/8.6; 252/8.9; 252/547

[58] Field of Search ..... 252/8.6, 8.8, 8.9, 252/547

[56] References Cited

U.S. PATENT DOCUMENTS

| | | | |
|---|---|---|---|
| 4,772,404 | 9/1988 | Fox et al. | 252/8.8 |
| 5,114,600 | 5/1992 | Biggin et al. | 252/8.6 |
| 5,126,061 | 6/1992 | Michael | 252/8.6 |
| 5,133,885 | 7/1992 | Contor et al. | 252/8.6 |
| 5,180,508 | 1/1993 | Birkhan et al. | 252/8.8 |
| 5,232,612 | 8/1993 | Trinh et al. | 252/8.6 |
| 5,300,242 | 4/1994 | Nichols et al. | 252/38 |
| 5,399,272 | 3/1995 | Swartley et al. | 252/8.8 |
| 5,407,589 | 4/1995 | Turner | 252/8.8 |
| 5,427,697 | 6/1995 | Swartley et al. | 252/8.8 |

FOREIGN PATENT DOCUMENTS

| | | |
|---|---|---|
| 303473 | 2/1989 | European Pat. Off. . |
| 2173827 | 3/1986 | United Kingdom . |

OTHER PUBLICATIONS

*Problematik der Herstellung Konzentrieirter Hauschaltsweichspulmittel,* by Helmut Hein, published in *Tenside Detergents* 18 (1981) 5, pp. 243–246, (English tranlation also enclosed).

*Primary Examiner*—Paul Lieberman
*Assistant Examiner*—Michael P. Tierney
*Attorney, Agent, or Firm*—Bernard Lieberman; Murray M. Grill

[57] ABSTRACT

The pourability and softening performance of amidoamine fabric softeners, such as bis(tallow amidoethyl)-2-hydroxyethyl amine) is improved by blending with a quaternary diester fabric softener, such as N-methyl, N,N,N-triethanolamine ditallow ester quaternary ammonium salt. The amidoamine fabric softener includes at least 5% by weight of unsaturated higher alkyl groups. The compositions are concentrated with amounts of active softener compounds in excess of 25% by weight and, as such, may be used at low levels or maybe further diluted prior to use.

14 Claims, No Drawings

CONCENTRATED LIQUID FABRIC SOFTENING COMPOSITION

This application is a continuation-in part of prior application Ser. No. 08/092,186 filed Jul. 15, 1993, abandoned. The disclosure of the prior co-pending application Ser. No. 08/092,186, is hereby incorporated by reference.

FIELD OF INVENTION

This invention relates to liquid fabric softening compositions. More particularly, the invention relates to super concentrated liquid fabric softening compositions which are effective in softening fabrics in both soft and hard water and which are primarily intended as rinse cycle fabric softening compositions ready-for-use and dilute before use, including both products.

BACKGROUND OF THE INVENTION

Compositions containing quaternary ammonium salts or imidazolinium compounds having at least one long chain hydrocarbyl group are commonly used to provide fabric softening benefits when used in a laundry rinse operation. Numerous patents have been issued for these types of compounds and compositions.

More recently, however, in view of concerns for the environmental safety (e.g., biodegradability) of the quaternary compound softeners, as well as limits in the amounts of these cationic compounds which can be stably incorporated into the more convenient to use liquid formulations, there have been many proposals for partial or total replacements of the conventional "quat" fabric softeners which are exemplified by dimethyl distearyl (or ditallow) ammonium chloride and various imidazolinium compounds.

For instance in GB 2,032,479A, corresponding to EP 038862, to D. Fontanesi (assigned to Albright & Wilson Ltd.) water dispersible unquaternized hydroxyalkyl diamidoamine compounds of formula $$RNH\ ((CH_2)_nNR)_mR$$

wherein an average of from 20% to 80% of the R groups are $C_{12}$ to $C_{22}$ acyl, at least 20% of the R groups are $—CH_2CH_2OH$ or $—CH_2CHOHCH_3$ or mixtures of these groups, and any other R group is hydrogen, n is 2 or 3 and m is an integer of from 2 to 5, are provided as mobile pastes in the presence of lower alkanol solvents. This is stated to be in contrast to partially neutralized unquaternized diamidoamines which, while providing highly effective fabric softening properties, are too viscous even when diluted in the lower alkanol solvents for convenient handling.

U.S. Pat. No. 5,154,838 (corresponding to EP 0459211A2) to Yomamura, et al. (assigned to Kao Corp.) discloses an aqueous liquid softener composition based on an amidoamine compound which is the condensation reaction product of a di- or tri-amine of formula (I):

$$R^1HN(C_mH_{2m}NH)_nH \qquad (I)$$

with a fatty acid of formula (II):

$$R^2\underset{\underset{O}{\|}}{C}—OH \qquad (II)$$

wherein $R^1$ represents a straight or branched chain, saturated or unsaturated hydrocarbon group having 8 to 24 carbon atoms, $R^2$ represents a straight or branched, saturated or unsaturated hydrocarbon group having 7 to 23 carbon atoms, m represents 2 or 3, and n is 1 or 2. These compounds, which are neither hydroxylated or ethoxylated, are noted to have high dispersibility in rinse water, especially when the amidoamine compound is used in the form of its neutral salt.

U.S. Pat. No. 5,108,628 to Uphues, et al. (Henkel) discloses certain aliphatic carboxylic acid amidoamines which are obtained by reaction of polyamines (e.g., diethylentriamine, aminoethyl ethanolamine) with carboxylic acid mixtures containing ether carboxylic acids ($R—O—(CH_2CH_2O)_n—CH_2COOH$, $R=C_{8-18}$ alkyl, $C_{8-18}$ alkenyl or $CH_2—COOH$, n=2 to 20, in combination with aliphatic $C_{8-22}$ monocarboxylic acids and/or amide-forming aliphatic C8–22 monocarboxylic acid derivatives) as fabric softeners stable in the presence of electrolytes.

In U.S. Pat. No. 5,133,885 to L. Contor, et al. (corresponding to EP 0423894, both assigned to Colgate-Palmolive Co., the assignee of the present invention) fabric softening compositions are described which are aqueous dispersions of a fatty acid ester quat of formula:

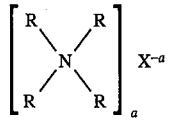

where one or two R groups represent an aliphatic ester residue of from 12 to 30 carbon atoms of formula $CH_{2n}OCOR_4$, and the remaining R groups represent lower aliphatic, aryl or hydroxyalkyl groups, $X^-$ is an anion and "a" represents the ionic valence of the anion, and a fatty acid amidoamine softener of formula:

$$R^1CONH(CH_2)_m\underset{\underset{R^2}{|}}{N}—R^3$$

where $R^1$ is a $C_{12}$ to $C_{30}$ alkyl or alkenyl group, $R^2$ represents $R^1$, $R^1CONH(CH_2)_m$ or $CH_2CH_2OH$; $R^3$ represents hydrogen, methyl, or $(CH_2CH_2O)_pH$, m is a number of 1 to 5 and p is a number of 1 to 5, at a weight ratio of ester quat to amidoamine of from 10:1 to 1.10. This patent discloses total amounts of esterquat and amidoamine ranging from 3% to 60% by weight, however, compositions containing at most 8% by weight of active softeners are disclosed.

U.S. Pat. No. 5,180,508 to Birkhan, et al. (corresponding to EP 0413249, assigned to REWO Chemische) discloses aqueous fabric softener rinsing agents based upon a mixture of quaternary salt compounds: a first component (a) of formula (I)

$$[(R^2—\overset{\overset{(R^3)_x}{|}}{N}—(CH_2\overset{\overset{R}{|}}{C}H—OR^1)_{3-n}]_g^{m+}mA^{-g} \qquad (I)$$

wherein, each R is independently hydrogen or lower alkyl;

each $R^1$ is hydrogen or an alkylcarbonyl group containing 15–23 carbon atoms, provided that at least one of $R^1$ is an alkylcarbonyl group;

each $R^3$ is an alkyl group containing 1–4 carbon atoms which is unsubstituted or substituted with 1, 2, or 3 hydroxy groups;

each $R^2$ is an alkyl group containing 1–4 carbon atoms which may be unsubstituted or substituted with 1, 2, or 3 hydroxy groups, or is a group of the formula:

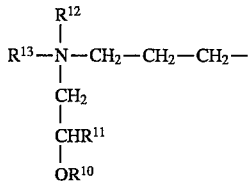

(II)

$R^{13}$ is an alkyl group containing 8–22 carbon atoms; $R^{12}$ is an alkyl group containing 1–4 carbon atoms which is unsubstituted or substituted with 1, 2, or 3 hydroxy groups;

$R^{11}$ is hydrogen or lower alkyl;

$R^{10}$ is hydrogen or alkylcarbonyl group containing 14–22 carbon atoms;

A is an anion of a quaternizing agent;

n is 0 or 1;

x and y are independently 0 or 1 with the proviso that (x+y)+(3–n)=4; and m is 1 or 2; and g is 1, 2 or 3, such that (m/g)(g)=m, and a second component (b) which is a quaternary salt of an imidazolinium compound (III), an amidoamine compound (IV), an ammonium compound (V), or diimidazolinium compound (VI). The amidoamine amine compound has the formula:

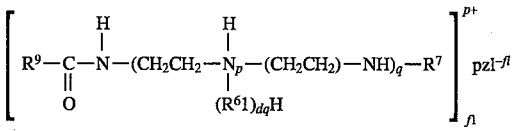

(IV)

wherein $R^6{}_1$ is CHX—CHY—O;

X and Y are independently hydrogen or lower alkyl (but not both alkyl);

$R^7$ is an alkylcarbonyl group containing 4–22 carbon atoms or H;

$R^9$ is an alkyl group containing 14–22 carbon atoms;

$Z_1$ is a water-soluble monobasic or polybasic anion;

d and $d_1$ are independently 0–6; q is 0 or 1; $f_1$ is 1, 2 or 3; p is 1–3; and p+q≧2.

The mixture of the soft-rinsing agent (a) and (b) constitutes from 10 to 25% by weight of the composition at ratios of (a):(b) of from 1:9 to 9:1. The alkyl groups in $R^7$ and $R^9$ are preferably completely saturated. Viscosity control agents, including electrolyte salts, e.g., calcium chloride, may be included.

U.S. Pat. No. 4,724,089 to König, et al. discloses aqueous dispersions of certain amines, including reaction products of higher fatty acids with a polyamine (e.g.,

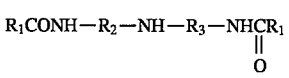

where $R_1$=acyclic ali-phatic $C_{15}$–$C_{21}$ hydrocarbon; $R_2$ and $R_3$= divalent $C_1$–$C_3$ alkylene groups) with a dispersing aid (e.g., HCl) and, optionally, quaternary ammonium salt (e.g., diamido (alkoxylated) quaternary ammonium salts). Relatively small amounts of electrolyte, e.g., $CaCl_2$, can be added to adjust viscosity.

EP 0295,386 to Ruback, et al. discloses a free-flowing softening washing rinse concentrate containing (a) from 18 to 50 weight percent of a mixture of at least two quaternary ammonium salts: (A) 10–90 wt % of triethanol-amine ester quaternary ammonium compound, and (B) 90 to 10 wt % of another quaternary compound including quaterized amidoamine (or equivalent esteramine or thioamine) and (b) water and optional conventional additives.

While these and many other proposals are known for improved fabric softening compositions, nevertheless, still further improvements are desired.

One such proposal is described by Schramm, et al. in the commonly assigned, copending application Ser. No. 07/995,102, filed Dec. 22, 1992. According to this proposal stable, aqueous, pourable and water dispersible, fabric softener compositions which include (A) a fabric softening effective amount of an inorganic or organic acid salt of a finely divided softening compound of formula (I):

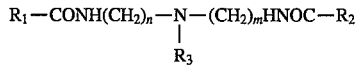

(I)

wherein $R_1$ and $R_2$, independently, represent $C_{12}$ to $C_2O$ alkyl or alkenyl; $R_3$ represents $(CH_2CH_2O)_pH$, $CH_3$ or H; n and m are each a number of from 1 to 5; and p is a number of from 1 to 10; (B) a dispersant stabilizing effective amount of a dispersant having the formula ( II ) , (III ) , (IV) or (V):

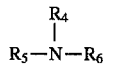

(II)

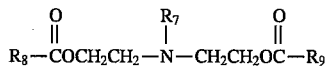

(III)

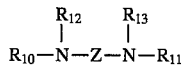

(IV)

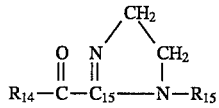

(V)

wherein, $R_4$ represents a hydrocarbon group having from 8 to 22 carbon atoms, $R_5$ represents a hydrocarbon group having from 1 to 22 carbon atoms, $R_6$ represents $C_1$–$C_4$ alkyl or hydroxyalkyl, $R_7$ represents $C_1$–$C_4$ alkyl or hydroxyalkyl, $R_8$ and $R_9$ each, independently represent a hydrocarbon group having from 8 to 22 carbon atoms, $R_{10}$ represents a hydrocarbon group having from 8 to 22 carbon atoms, $R_{11}$ represents a hydrocarbon group having from 1 to 22 carbon atoms which may have an hydroxyl group substituent, $R_{12}$ and $R_{13}$, independently, represent $C_1$–$C_4$ alkyl or hydroxyalkyl, Z represents a divalent alkylene group of from 1 to 6 carbon atoms, or an hydroxyl substituted alkylene group;

$R_{14}$ represents a hydrocarbon group having from 8 to 22 carbon atoms;

$R_{15}$ represents a hydrogen atom or $C_1$–$C_4$ alkyl or hydroxyalkyi; and (C) an aqueous solvent, were provided as ready-to-use products or as concentrates to be used at reduced levels or which may be diluted with water prior to use at the same or similar levels as the ready-to-use products. In the ready-to-use composition the total amount of amidoamine softener (A) and stabilizing dispersant (B) is disclosed to fall in the range of from about 2 to 8% by weight. In the concentrated form the total amount of (A) and (B) is generally in the range of from about 12 to 60% and may be diluted at ratios of water:concentrate as high as about 4:1 to even 8:1 or 9:1, and still provide acceptable softening performance, equivalent or better than that achieved using conventional quaternary cationic surfactant softeners, such as dimethyl distearyl ammonium chloride (DMDSAC).

An alternative embodiment of the Schramm, Jr., et al. fabric softener aqueous liquid compositions which is adaptable for use in the rinse cycle of a laundering process and which is described as stable, pourable, and dispersible in water, includes the following ingredients:

(A') an inorganic or organic acid salt of bis(hydrogenated tallow amidoethyl) hydroxyethyl amine, (B') an inorganic or organic acid salt of bis(non-hydrogenated tallow amidoethyl) hydroxyethyl amine, with the total amount of (A') and (B') being from about 2% to about 50% by weight of the composition, and the ratio by weight of (A') to (B') being in the range of from about 10:1 to abut 1.5:1, and an aqueous solvent.

The compositions disclosed in the aforesaid application Ser. No. 07/995,102 of Schramm, Jr., et al. provide highly effective stable and pourable liquid fabric softener compositions; nevertheless, in practice it is found that with concentrations of the amidoamine fabric softening compound (e.g. Varisoft 510) in excess of 11 weight percent in the presence of certain emulsifiers, such as hydrogenated tallow, the product viscosity becomes excessively high, even in the presence of electrolytes (e.g. $CaCl_2$) or solvents (e.g. propanol). While higher total concentrations of the amidoamine were achieved using the soft tallow product Varisoft 512 or mixtures of Varisoft 512 and hard tallow product, Varisoft 510, the softening performance of the Varisoft 512 containing compositions, presumably due to the lack of hydrogen bonding sites on the protonated soft tallow compound, was not sufficiently improved.

Ways to increase the concentration in the liquid fabric softening composition of the amidoamine softener compound varisoft 510 in view of the very good environmental attributes and favorable acute toxicity data of this compound and its strong softening performance are desired. However, as noted above, at high concentrations the viscosity increases substantially until gelation occurs.

James and Ogden (Journal of the American Oil Chemist's Society 56 1979) describe that the viscosity of aqueous cationic dispersions is highly affected by the manufacturing variables such as the temperature of the dispersion, electrolyte content, and method of stirring. Not only the dimension and speed of the stirrer but also the stirring time and the size and construction of the mixing tank influence the fineness of the dispersion. They also point out that dispersions of low viscosity can be produced directly by homogenization.

It was recently discovered that the incorporation of cyclic imidazolinium compounds can increase the concentratability of fatty amido tertiary amine softeners and also significantly improve the softening efficacy of Varisoft 510. This discovery is described in greater detail in the commonly assigned copending application Ser. No. 08/065,207, filed May, 20, 1993 (IR 5206/17). According to this copending application a stable, pourable, water dispersible aqueous liquid fabric softener composition includes:

(A) a softening effective amount of an inorganic or organic acid salt of a finely divided fatty amido tertiary amine compound of formula (I):

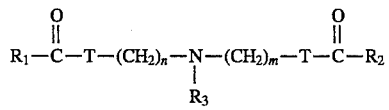

(I)

wherein $R_1$ and $R_2$, independently, represent $C_{12}$ to $C_{20}$ alkyl or alkenyl; $R_3$ represents $(CH_2CH_2O)_pH$, $CH_3$ or H; T represents O or NH; n and m are each, independently, a number of 1 to 5; and p is a number of from 1 to 10; (B) a viscosity controlling and softening improving effective amount of a cyclic imidazolinium compound of formula (II):

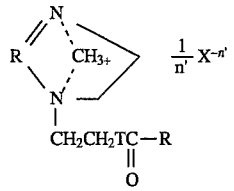

(II)

wherein each R represents $C_{12}$ to $C_{20}$ alkyl or alkenyl;

T represents O or NH; and

X represents a counter-anion of valence n'; and (C) an aqueous solvent including an anti-gelling effective amount of electrolyte. Compositions containing up to 25 wt % of active ingredients (A) and (B) are exemplified, with amounts of (A) and (B) up to 60% being disclosed.

Notwithstanding the various improvements in formulating concentrated aqueous liquid fabric softening compositions suitable for use as rinse cycle softeners still further improvements are desired for such compositions containing at least 25 weight percent of cationic softeners with respect to one or more of the following properties: low viscosity (e.g., below about 2,000 cps at 20° C. and preferably below about 1,500 cps), stability against phase separation for extended periods, stability against increasing. viscosity over extended periods, improved softening performance and rapid dispersibility of the composition when added to water, including cold, warm or hot rinse water. Furthermore, it is desired to achieve these higher concentrations (to reduce packaging costs, etc.) in still pourable liquid compositions without requiring high pressure homogenization or emulsifying agents which do not otherwise contribute to softening performance. Still another important consideration is the softening performance of the composition in hard water as well as soft water.

Accordingly, it is an object of this invention to provide low viscosity, stable and flowable aqueous dispersions containing high concentrations of environmentally acceptable fabric softeners to provide enhanced softening performance.

Another object of the invention is to provide such low viscosity, stable and flowable aqueous dispersions With nitrogen compound fabric softeners in amounts of at least 25 percent by weight of the composition and which. are suitable for use with or without further dilution to provide softening performance at least equivalent to that obtainable with present commercially available rinse cycle fabric softeners.

SUMMARY OF THE INVENTION

The above and other objects of the invention which will become more apparent from the following detailed description and examples, has been achieved by a stable, pourable, aqueous liquid fabric softening composition. This composition is a dispersion containing particles from about 0.01 μm to about 25 μm of softening components (A) and (B), see below. These two softening components comprise from about 25% to about 50% by weight of the softening composition, with the proviso that at least 20% of the hydrocarbon.groups in these two softening components are unsaturated carbon to carbon bonds. Further, the composition also requires a third ingredient (C), wherein:

(A) is an inorganic or organic acid salt of a fatty tertiary amine compound of formula (I):

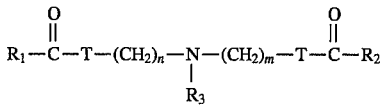

(I)

wherein $R_1$ and $R_2$, represent $C_{12}$ to $C_{20}$ aliphatic hydrocarbon groups; $R_3$ represents $(CH_2CH_2O)_pH$, $CH_3$ or H; T represents O or NH; n and m are each, independently, a number of from 1 to 5; and p is a number of from 1 to 10;

(B) is a biodegradable fatty ester quaternary ammonium compound of the formula (II):

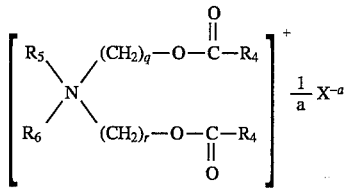

(II)

wherein each $R_4$, independently, represent an aliphatic hydrocarbon group having from 8 to 22 carbon atoms; $R_5$ represents $(CH_2)_s$—$R_7$ (where $R_7$ represents an alkoxy carbonyl group containing from 8 to 22 carbon atoms, benzyl, phenyl, $(C_1$–$C_4)$ alkyl substituted phenyl, OH or H); $R_6$ represents $(CH_2)_t$—$R_8$ (where $R_8$ represents benzyl, phenyl, $(C_1$–$C_4)$ alkyl substituted phenyl, OH or H); q, r, s and t, each independently represent a number of from 1 to 3; and $x^{-a}$ is an anion of valence a; and (C) is an aqueous solvent including an anti-gelling effective amount of electrolyte.

The present invention .also provides a method of imparting softness to fabrics by contacting the fabrics with a softening effective amount of the invention fabric softener composition; generally and preferably, in the rinse cycle of an automatic laundry washing machine. The compositions may be diluted with water prior to adding the composition to the washing machine (e.g., the rinse cycle dispenser), or may be added, at reduced amount, without dilution, i.e., ready to use.

DETAILED DESCRIPTION AND PREFERRED EMBODIMENTS

The present invention was developed as part of an extensive research program to evaluate available fabric softening compounds which do not pose the risk of, or at least reduce the risk of, causing environmental damage associated with conventional cationic quat fabric softeners, such as dimethyl distearyl ammonium chloride (DMDSAC) yet which offer equivalent or superior softening performance to DMDSAC and which are amenable for use in concentrated products. The latter requirement is important in view of the trend in the industry to sell concentrated products which require less packaging and lower shipping costs on a per unit or per usage basis and, therefore, can be characterized as environmentally and user friendly.

As a result of this extensive research it was found that the class of amidoamines, and particularly fatty amidotertiary amines and corresponding esters of the foregoing formula (I), and which are commercially available, for example, under the Varisoft trademark from Sherex Chemical Co., when provided in the form of its acid (protonated) complex, met the objectives of high efficacy softening performance and environmental acceptability.

Although not wishing to be bound by any particular theory of operation it is believed that the good softening performance is due to the excellent inherent dispersibility of the finely divided amidoamine softener when the compound is protonated as its acid complex. Such excellent inherent dispersibility is believed to result from the presence of the diamido amine hydrophilic group, which may be further enhanced by a moderate level of ethoxylation (e.g., when $R_3$ represents $(CH_2CH_2O)_pH$). On the other hand, the presence of the two long chain hydrocarbon groups ($C_8$–$C_{20}$ alkyl or alkenyl) contribute to effective fabric softening.

However, the concentratability of the fatty tertiary amido amine fabric softeners of formula (I) was found to be limited to no more than about 11% by weight before gelation occurs or otherwise unacceptably high Viscosity results. It is presumed that this phenomenon is the result of the crystallinity of fatty tertiary amine, that is, the formation of a liquid crystalline phase. In general, the viscosity increase in concentrated samples and over time is believed to be-associated with the formation of multilayered vesicle structures which trap more and more water and thus, in turn, the composition exhibits an increase in viscosity. In other words, the phase volume of the composition increases with increasing softener concentration and time while the continuous (aqueous) phase gradually decreases with time.

As described in the aforementioned Schramm, Jr., et al. application Ser. No. 07/995,102, it has been observed that Varisoft 512 (soft tallow tertiary amine) is capable of reducing the crystallinity of, and concentratability of Varisoft 510 (hydrogenated (hard) tallow tertiary amine.) but with relatively poorer softening performance. This poorer softening efficacy is probably due. to the lack of a hydrogen binding site on the protonated compound (i.e., the election pair or nitrogenis "used up" by protonation) for hydrogen bonding with the fabric cellulose. In any case, the softening performance of the tertiary amine compound containing higher aliphatic, amide or ester groups containing unsaturation (carbon to carbon double bonds), e.g., soft tallow amide, etc., is generally significantly poorer than the corresponding compounds which are fully saturated, e.g., hydrogenated tallow amide.

While it has been known in the past that stability against phase separation of aqueous dispersions of finely divided substances, including fabric softening or other fabric treating agents, may be improved by incorporating certain dispersing aides, co-surfactants, emulsifiers, and the like, into the aqueous dispersions, the art has not provided any general guidelines or principles for determining which of the myriad possible candidate compounds would be able to provide the desired improvement in stability and reduction in viscosity, much less improvement in softening performance.

The present inventors have unexpectedly found that the fatty ester quaternary ammonium compound of formula (II), when added to an aqueous dispersion of the fatty amide (or ester) tertiary amine compound fabric softener of the formula (I) containing a significant level of unsaturation creates a stable, pourable, efficacious softening composition. It had previously been believed that efficacious softening could not be obtained from unsaturated alkyl group containing softening compounds. Analysis of such unsaturated alkyl group containing compounds are shown in Tables A and B, below. Table A shows the pourability of such systems and table B the softening efficacy. In specific, Table A shows the Viscosity effect (pourability) within a representative aqueous dispersion held at 4° C. for 3 weeks to ensure stability—composed of 10.5% by weight of a 100% saturated diesterquat (per formula II), and respectively varying from 0 to 17.5% by weight of a mixture of a soft tallow, about 45% unsaturated, tertiary amidoamine (AA(S) or AmidoAmine-(Soft)) and 17.5% to 0% of 100% saturated tertiary amidoamine (per formula I); in the presence of minor quantities of HCl, $CaCl_2$, dye, preservative, and perfume. Table B, also using an identical three major component system of tertiary amidoamines and diesterquat diluted 8 times as when used by consumers, shows softening efficacy at varying levels of unsaturation versus a standard (the standard being the softening effect using a 5% level of ditallow dimethylammonium chloride (DTDMAC) containing product).

TABLE A

Unsaturated Tertiary Amidoamine vs. Viscosity (See Note 2)

| Weight % of AA(S) in Amidoamine Fraction | % of [Unsaturated Carbon-to-Carbon Bonds in the] Hydrocarbon Groups with Unsaturated Bonds of Formulas (I) & (II) | Viscosity (cp) |
|---|---|---|
| 0% | 0% | 10,000 |
| 20% | 9% | 3,400 |
| 32% | 14% | 2,600 |
| 45% | 20% | 635 |
| 58% | 26% | 300 |
| 83% | 37% | 130 |

Notes on TABLE A:
1. For example, 30% AA(S) composition within the Amidoamine Fraction is equal to an overall weight percent of about 3.8% unsaturation.
2. In subsequent examples, wherein the esterquat component contains unsaturated moieties, the percentage of unsaturated within the amidoamine fraction can be proportionately reduced from that shown in Table A above.

Notes on Table A:

1. For example, 30% AA(S) composition within the Amidoamine Fraction is equal to an overall weight percent of about 3.8% unsaturation.

2. In subsequent examples, wherein the esterquat component contains unsaturated moieties, the percentage of unsaturated within the amidoamine fraction can be proportionately reduced from that shown in Table A above.

TABLE B

Amount of Unsaturation vs. Softening Effect

| Weight % of AA(S) in Amidoamine Fraction | % of [Unsaturated Carbon-to-Carbon Bonds in the] Hydrocarbon Groups with Unsaturated Bonds of Formulas (I) & (II) | Relative Softening vs. Standard of 5% Concentration of DTDMAC @ 8.1 (See Note Below) |
|---|---|---|
| 20% | 9% | 8.7 |
| 58% | 26% | 8.2 |
| 70% | 32% | 8.1 |
| 83% | 37% | 8.0 |

Note on Table B: The softening level shown is on a scale of from 0 to 10; wherein 0 represents no consumer preceivable softening and 10 being the maximum level of consumer preceivable softening. The 8.1 level corresponds to a 40 EQ emulsion, as defined in this specification.

The mixture of the compounds of formulas (I) and (II) allow the compositions to be formulated as concentrates for subsequent dilution (if desired) at ratios as high as 8:1 or higher, while still remaining pourable in the concentrated form. These same concentrated formulas may, of course, be used without dilution but in smaller quantities to achieve superior softening performance.

Thus, the compositions of this invention are stable, pourable, and rapidly water dispersible aqueous dispersions which contain, (A) a fabric softening effective amount of an inorganic or organic acid salt of fatty amido (or ester) tertiary amine of formula, with a significant level of unsaturated bonds, (I) and (B) a synergistic viscosity reducing and fabric softening improving ester quaternary ammonium compound of formula (II), wherein the total amount of (A) and (B), combined is from about 25 to about 50% by weight, especially from 28% to 38% by weight. The aqueous dispersion within these amounts of fabric softening active ingredients is of low viscosity, namely, remains pourable at ambient temperature, particularly less than 1500 cps at 20° C.

The fabric softening active compound (A) is an amido (or ester) tertiary amine of formula (I):

$$R_1-\overset{\overset{\displaystyle O}{\|}}{C}-T-(CH_2)_n-\underset{\underset{\displaystyle R_3}{|}}{N}-(CH_2)_m-T-\overset{\overset{\displaystyle O}{\|}}{C}-R_2 \qquad (I)$$

In the above formula $R_1$ and $R_2$ are each, independently, long chain aliphatic hydrocarbons, e.g., alkyl or alkenyl groups having from 12 to 30 carbon atoms, preferably from 16 to 22 carbon atoms. Linear hydrocarbon groups, such as, for example, dodecyl, dodecenyl, octadecyl, octadecenyl, behenyl, eicosyl, etc., are preferred. Typically, $R_1$ and $R_2$, and more generally $R_1$—CO— and $R_2$—CO, will be derived from natural oils containing fatty acids or fatty acid mixtures, such as coconut oil, palm oil, tallow rape oil, and fish oil. Chemically synthesized fatty acids are also usable. Generally and preferably $R_1$ and $R_2$ are derived from the same fatty acid or fatty acid mixture. According to this invention, it has been discovered that when $R_1$ and $R_2$ are derived from or-contain up to about 80%, but preferably not more than 65% by weight of unsaturated (i.e., alkenyl) groups, the relatively poor softening performance of unsaturated moieties of the compound of formula (I) is overcome by the combination with the ester quat compound (B) of formula (II) and an effective amount of a viscosity reducing electrolyte.

$R_3$ in formula (I) represents $(CH_2CH_2O)_pH$, $CH_3$, or H, or mixtures thereof. When $R_3$ represents the preferred $(CH_2CH_2O)_pH$ group, p is a positive number representing the average degree of ethoxylation, and is preferably from 1 to 10, especially 1.4 to 6, and more preferably from about 1.5 to 4, and most preferably, from 1.5 to 3.0. n and m are integers of from 1 to 5, preferably 1 to 3, especially 2.' The compounds of formula (I) in which $R_3$represents the preferred $(CH_2CH_2O)_pH$ group are broadly referred to herein as ethOxylated amidoamines (when T-NH) or ethoxylated ester amines (when T=O), and the term "hydroxyethyl" is also used to describe the $(CH_2CH_2O)_pH$ group.

Most especially preferred is the compound of formula (I) which is commercially available under the tradenameS Varisoft 512 (a 90% concentration with a 10% organic solvent), or Varisoft 511 (approximately a 100% active ingredient concentration), available from Sherex Chemical Company, which is bis(tallow-amidoethyl)-hydroxyethyl amine of formula $$((\text{Tallow})\text{-}\overset{\overset{\displaystyle O}{\|}}{C}-NH-CH_2CH_2)_2-N-(CH_2CH_2O)_xH$$

(X = 1.5 to 3.0)

In place of a portion of Varisoft 512 or-511, the corresponding hydrogenated tallow amidoamine derivative, available from Sherex under the tradename Varisoft 510:

$$\text{(H-Tallow)-}\overset{\overset{\displaystyle O}{\|}}{C}\text{NH}-(CH_2)_n-\underset{\underset{\displaystyle (CH_2CH_2O)_xH}{|}}{N}-(CH_2)_m\text{NH}\overset{\overset{\displaystyle O}{\|}}{C}\text{-(H-Tallow)}$$

may be used.

When mixtures of hydrogenated and non-hydrogenated softener compounds are used the percentage of alkenyl groups is based on the total of both compounds. For example, in the case of Varisoft 512 which is derived from a natural (beef) tallow (often referred to as "soft-tallow" or sometimes, simply as "tallow" or AA(S)) the average fatty chain composition is typically (variations occur depending on the particular source, time of year, feed supply, etc.):

$C_{14}$=5% including 1% of mono-unsaturated chains (alkyl chains containing one carbon to carbon double bond, i.e. alkenyl)

$C_{16}$=30% including 4% of mono-unsaturated chains.

$C_{18}$=65% including 39% of mono-unsaturated chains and 1% di-unsaturated chains.

Therefore, in soft-tallow there is about 45% of unsaturated alkyl chains and 55% of saturated alkyl chains. Conversely, in hydrogenated tallow (also sometimes referred to as "hard tallow" or "H-tallow" or AA(H)) all of the unsaturated chains are converted to saturated chains. Therefore, H-tallow contains about 100% of saturated chains.

Accordingly, for mixtures of Varisoft 512 or 511, and Varisoft 510, the amount of Varisoft 512 or 511 should be at least about 25% of the mixture to provide at least about 11% by weight of unsaturated chains within the overall amidoamine component.

While the long chains ($R_1$ and $R_2$) of the formula (I) compounds may, theoretically, be entirely unsaturated, in practice the softening performance of such unsaturated compounds is not sufficient. Therefore, it is preferred to limit the amount of the unsaturated chains to no more than about 80%, preferably no more than about 65%, by weight based on the total of the $R_1$ and $R_2$ groups.

Since Varisoft 512 and Varisoft 511 both contain about 45% of unsaturated long chain alkyl groups, either of these amidoamine fabric softeners may be used by itself. However, to achieve still higher softening performance, while maximizing the total amount of fabric softening active ingredients [(A) and (B) combined] it is preferred to maintain the unsaturated alkyl chains at below about 36% by weight, especially below about 30% by weight, based on the total of the higher alkyl groups ($R_1$ and $R_2$) in the formula (I) compounds.

Therefore, for the preferred mixtures of Varisoft 510 and Varisoft 512 the ratio of the hard-tallow (510) to soft tallow (512) compounds is in the range of from about 20 to 60:80 to 40, more preferably from about 45 to 55:65 to 45; such as, for example, 55:45 (corresponding to about 20% by weight of unsaturated chains). The additional unsaturation contributed to the overall formulation by the addition of a quaternized ammonium ester, discussed below, may effect the proportionate amount of unsaturation required from the AA(S) component (Varisoft 512) herein discussed.

In the non-neutralized (nonprotonated) form the fatty amide or fatty ester tertiary amine compounds are hardly or not at all dispersible in water. Therefore, in the present invention, the amine function of the amidoamine or ester amine compound is at least partially neutralized by a proton contributed by a dissociable acid, which may be inorganic, e.g., HCl, $H_2SO_4$, $HNO_3$, etc. or organic, e.g. acetic acid, propionic acid, lactic acid, citric acid, glycolic acid, toluene sulfonic acid, maleic acid, fumaric acid, and the like. Mixtures of these acids may also be used as may any other acid capable of neutralizing the amine function. The acid neutralized compound is believed to form a reversible complex, that is, the bond between the amine function and proton will disappear under alkaline pH conditions. This is in contrast to quaternization, e.g., with a methyl group, wherein the quaternizing group is covalently bonded to the positively charged amine nitrogen and is essentially pH independent.

The amount of acid-used will depend on the "strength" of the acid; strong acids such as HCl, and $H_2SO_4$ completely dissociate in water, and, therefore, provide a high amount of free protons ($H^+$), while weaker acids, such as citric acid, glycolic acid, lactic acid, and other organic acids, do not dissociate completely and, therefore, require a higher concentration to achieve the same neutralizing effect. Generally, however, the amount of acid required to achieve complete protonation of the amine, will be achieved when the pH of the composition is rendered strongly acidic, namely between about 1.5 and 4. HCl and glycolic acid are preferred, and HCl is especially preferred.

Furthermore, the amount of acid used for neutralization should be sufficient to provide at least an 0.5:1 molar ratio, and up to about a 1:1 molar ratio of the acid to the total amount of fabric softener fatty amide or ester tertiary amine. For the organic carboxylic acids, however, it is preferred to use a molar excess of the neutralizing acid. Molar ratios of organic carboxylic acid to the compound of formula (I) up to about 6:1, for example from 1.5:1 to 6:1, such as 2:1, 3:1 or 4:1, have been found advantageous in terms of stability and/or softening performance. The use of glycolic in molar excess is especially preferred.

However, it has also been found that partially neutralized ethoxylated fatty amide or fatty ester tertiary amines are highly stable. Therefore, in some cases molar ratios of acid (as HCl) to ethoxylated amine (or ester) of formula (I) of from 0.5:1 to about 0.95:1, such as 0.6:1 and 0.7:1, can be advantageously used. For the mineral acids, such as HCl, molar ratios above 1:1 should generally be avoided since, otherwise, a gel may form.

The second essential fabric softener compound according to this invention is the biodegradable, with a quaternized ammonium ester compound (B) of the following formula (II)

$$\left[R_4-\overset{\overset{\displaystyle O}{\|}}{C}-O-(CH_2)_q-\underset{\underset{\displaystyle R_6}{|}}{\overset{\overset{\displaystyle R_5}{|}}{N^+}}-(CH_2)_r-O-\overset{\overset{\displaystyle O}{\|}}{C}-R_4\right]\frac{1}{a}X^{-a} \qquad \text{(II)}$$

Each $R_4$ independently represents an aliphatic hydrocarbon group having from 8 to 22 carbon atoms, and preferably 14 to 18 carbon atoms. $R_5$ represents the group $(CH_2)_s$–$R_7$ which, depending on $R_7$, may represent a long chain alkyl ester group ($R_7$=$C_8$–C22 alkoxy carbonyl), in which case the compounds of formula (III) are triester quaternary ammonium compounds.

Preferably, however, the fatty ester quaternary compounds are diester compounds, i.e. $R_7$ represents benzyl, phenyl, phenyl substituted by $C_1$–$C_4$ alkyl, hydroxyl (OH) or hydrogen (H). Most preferably $R_7$ represent OH or H, especially preferably OH, e.g. $R_5$ is hydroxyethyl.

q, r and s, each, independently, represents a number of from 1 to 3.

X represents a counter ion of valence a. For example, the diester quat of formula (III) may be a compound of the formula:

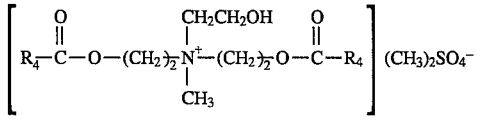

where each $R_4$ may be, for example, derived from hard or soft tallow, coco, stearyl, oleyl, and the like. Such compounds are commercially available, for example, Tetranyl AT-75, from Kao Corp. Japan, which is di-tallow ester triethanol amine quaternary ammonium methyl sulfate. Tetranyl AT-75 is based on a mixture of about 25% hard tallow and about 75% soft tallow. Accordingly, this product contains about 34% of unsaturated alkyl chains. A second example would be Hipochem X-89107, from High Point Chemical Corp.; which is an analogue of the Tetranyl AT-75 with about 100% saturation in the tallow moieties. However, in generally the quaternized ammonium ester compound of formula (III) may contain from about 5% to about 75% of unsaturated (long-chain) alkyl groups, preferably from about 20% to about 50% of unsaturated long-chain alkyl groups.

The compounds (A) of formula (I) and compounds (B) of formula (II) are used in admixture, preferably at ratios of about 5:1 to about 1:5, more preferably from 2:1 to 1:2, especially 1.7:1 to 1:1.7, whereby both softening performance and stability and pourability are improved. That is, notwithstanding the poor softening performance of the unsaturated long-chain alkyl compounds when used individually, when used with the ester quat compound (which also preferably contains carbon to carbon double bonds) either alone or in combination with the hydrogenated amido amine compound a surprisingly substantial improvement in softening performance is observed in pourable liquid formulations.

The total amounts of components (A) and (B) is from about 25 to about 40 wt. percent, preferably from about 28 to about 38 wt %, and the ratio, by weight of (A):(B) is from about 2:1 to 1:2, and especially, from about 1.7:1 to 1:1.

The compositions of this invention are provided as aqueous dispersions in which the fabric softener compounds of formula (I) and formula (II) are present in finely divided form stably dispersed in the aqueous phase. Generally, particle sizes of the dispersed particles of less than about 25 microns (μm), preferably less than 20 μm, especially preferably no more than 10 μm, on average are acceptable for both softening and stability insofar as the particle sizes can be maintained during actual use, typically in the rinse cycle of an automatic laundry washing machine. The lower limit is not particularly critical but from a practical manufacturing standpoint will not generally be below about 0.01 μm, preferably at least about 0.05 μm. A preferred particle size range of the. dispersed softener ingredients is from about 0.1 to about 8 μm.

However, one of the advantageous features of the compositions of this invention is that it is not necessary to subject the composition to high shear conditions, such as by high pressure homogenization. Simple mixing of the ingredients in water with a low shear mixer provides stable dispersions of finely divided-particles.

The aqueous phase of, the dispersion is primarily water, usually deionized or distilled water. Small amounts (e.g. up to about 5% by weight) of co-solvent may be present for adjustment of viscosity. Typically, as the co-solvent lower mono- and poly-hydroxy alcohols and aqueous will be used, generally in amounts up to about 8% by weight of the composition. The preferred alcohols and aqueous are those having from 2 to 4 carbon atoms, such as, for example, ethanol, propanol, isopropanol, and propylene glycol or ethylene glycol. Isopropyl alcohol (2-propanol) is especially preferred. However, co-solvents are not required and are generally avoided.

The compositions of this invention include an electrolyte to reduce dispersion viscosity. Generally, any of the alkaline earth metal salts of the mineral acids can be used as electrolyte. In view of availability, solubility and low toxicity, $CaCl_2$, $MgCl_2$ and $MgSO_4$ and similar salts of alkaline earth metals are preferred, and $CaCl_2$ is especially preferred. The amount of the electrolyte will be selected to assure that the composition does not form a gel. Generally, amounts of electrolyte salt of from about 0.05 to 2.0 wt %,-preferably 0.1 to 1.5 wt %, especially preferably 0.25 to 1.4 wt %, will effectively prevent gelation from occurring.

As is generally understood, the role of the electrolyte to inhibit gelation can be explained based on the assumption that the invention dispersions of the cationic softening compounds have a vesicular structure. The spacing of the multilayered vesicles in the liquid crystalline phases varies with the electrolyte concentration since it depends on the repulsion between the head groups in adjacent layers. The amount of the enclosed water tends to be reduced at high salt concentrations, causing a lowering of the disperse phase volume and the viscosity. However, if one exceeds a critical concentration of the electrolyte, this may lead to a destabilization of the emulsions by flocculation or coalescence. The phenomenon of flocculation or coalescence can be explained by considering the electrostatic stabilization of colloidal dispersions. Attractive as well as repulsive forces act on the individual particles of a dispersion. The repulsive forces increase exponentially as the particles approach each other, such as when the concentration of dispersion increases, and they become very strong when the electrical double layers (the counterions in the dispersion medium give rise to .the electrical double layers that surround the colloidal particles) that envelope each particle overlap. The thickness of the electrical double layers is very sensitive to the ionic strength of the dispersion medium. Increasing the ionic strength significantly dimishes the thickness of the double layer. The repulsive forces then become of insufficient magnitude and are no longer able to overcome the attractive van der Waals forces which may lead to dispersion flocculation or coagulation.

Another optional ingredient in the invention compositions is a rheology modifier to help reduce or eliminate variations in the aqueous dispersion viscosity over time. It should be understood, however, that so long as the viscosity does not increase to an unacceptably high level over the expected life of the produce (including transportation from the manufacturing plant to the market place, shelf-life in the market place, and duration of consumption by the end user) a rheology modifier is not necessary. For example, the viscosity after, for instance, 8 to 10 weeks, should preferably not exceed about 1500 cps (at 25° C.), especially preferably the viscosity should not exceed about 1500 cps (at 25° C.)-over the expected lifetime of the produce. In many cases, initial Viscosities of up to about 200 cps can be achieved and maintained.

Therefore, if there is concern about increase in product viscosity, or if changes in viscosity over time are considered undesirable, a rheology modifier can be added to the composition. Examples of rheology modifiers are well known in the art and may be chosen from, for example, polymeric rheology modifiers and inorganic rheology modifiers. Examples of the former type include polyquaternium compounds, such as Polyquaternium-24 (a hydrophobically modified polymeric quaternary ammonium salt hydroxyethyl-cellulose, available from Amercho, Inc.); cationic polymers such as copolymers of acrylamide and quaternary ammonium acrylate; the Carbopols, and the like. Examples of inorganic rheology modifiers include, for example, alumina. Generally, only minor amounts, up to about 1.0%, preferably up to about 0.8%, such as, for example, 0.01 to 0.60 percent, by weight, provide acceptable viscosity levels over time.

Another additive which has been found to be useful as a rheology modifier is citric acid, generally in amounts of from about 0.05 to 1.0 wt %,- preferably from about 0.1 to 0.6 weight percent. Fatty alcohols and non-ionic surfactants may also be included in minor amounts (e.g. up to about 5% by weight, preferably up to about 2% by weight)-as viscosity modifiers and/or emulsifying agents.

Other optional components commonly used in fabric softening compositions may be added-in minor amounts to-enhance either the appearance or performance properties of the liquid fabric softener compositions of this invention. Typical components of this type include, but are not limited. to colorants, e.g., dyes or pigments, bluing agents, preservatives, germicides and perfumes.

The subject liquid fabric softener compositions may be prepared by adding the active ingredients, usually as a melt, to the heated aqueous phase to which the acid component has been pre-mixed, under mixing. Low-shear mixing is generally sufficient to adequately and uniformly disperse the active ingredients in an throughout the aqueous phase. Further particles size reduction can be obtained by subjecting the composition to further treatment such as in a colloid mill or by high pressure homogenization, however, as previously noted, no significant improvement in softening performance has been associated with such particle size reduction.

The final product, whether in concentrated or diluted form must be easily pourable by the end user. Generally, therefore, final product viscosity (for a freshly prepared sample) should not exceed about 1500 centipoise, preferably not more than 1000 centipoise, but should not be too low, for example not less than about 50 centipoise. The preferred viscosity for the invention concentrated product is in the range of 120 to 1000 centipoise. As used herein, unless otherwise specified, viscosity is measured at 25° C. (22°–26°C.) using a Brookfield RVTD Digital Viscometer with Spindle #4 at 20 rpm.

The concentrated compositions may be diluted by a factor of generally 4:1 or more, preferably up to about 8:1 or even 9 to 10:1. Concentrated products with up to about 40 weight percent of softeners may be prepared and will remain pourable and stable against phase separation or suspended particle agglomeration for extended periods of time. The concentrated products of this invention provide equivalent softness at the same use level (e.g., about 110 ml for standard European washing machines) as a (hypothetical) softener product containing up to about 50 weight percent or more of ditallow dimethyl ammonium chloride (DTDMAC). For example, a composition with about 28% of softeners (see Example 2, Composition No. 14 hereinafter) can be diluted to about 5% actives to provide equivalent or superior softening performance to a product containing about 7% of DTDMAC. After dilution, or for a ready-to-use product, the composition will normally contain sufficient softener to be effective when added to the rinse water in an amount of about one-eighth to three quarters of a cup (1 to 6 ounces) providing about 25 ppm to about 90 ppm of softener in the rinse water.

In the above description and in the following examples and claims all parts and percentages are given on a weight basis unless otherwise stated.

EXAMPLE 1

This example demonstrates the ability of the partially unsaturated amidoamine compound of formula (I) to control the viscosity of aqueous dispersion of softening active compounds with total amounts of the active softening compounds (A) and (B) in excess of about 25 weight percent.

The compositions shown in Table 1 were prepared as described below.

TABLE 1

| Composition | #1 (wt %) | #2 (wt %) | #3 (wt %) | #4 (wt %) | #5 (wt %) | #6 (wt %) |
|---|---|---|---|---|---|---|
| Varisoft[1] 512 (A) | 12 | 12 | 15 | 16 | 17 | 17 |
| Esterquat[2] (B) | 12 | 12 | 15 | 16 | 17 | 17 |
| Emulsifier[3] | — | — | — | — | — | 2 |
| HCl | 0.87 | 0.87 | 1.08 | 1.08 | 1.22 | 1.22 |
| Defoamer[4] | 0.03 | 0.03 | 0.02 | 0.04 | 0.04 | 0.04 |
| $CaCl_2$[5] | 0.78 | 0.4 | 1.25 | 0.8 | 1.09 | 0.95 |
| $H_2O$ | balance to 100 | balance to 100 | balance to 100 | balance to 100 | balance to 100 | balance to 100 |

[1]bis(tallow amido ethyl) hydroxyethyl (nominally 2 ethylene oxide groups per molecule) amine (from Sherex Chemical Co.) (45% unsaturated alkyl chains)
[2]Tetranyl AT-75 (85% actives) from Kao Corp. Japan methyl triethanolamine-tallow diester quaternary ammonium methyl sulfate
[3]$C_{13}$–$C_{15}$ fatty alcohol, EO 20:1
[4]Dow 1430 silicone anti-foaming agent
[5]contained 0.02% BP-7050 polymer thickener from BP Chemicals. Ltd. United Kingdom The aqueous dispersion of compositions Nos. 1–6 were prepared by adding a molten mixture of the ester quat and Varisoft 512 at 35° to 45° C. to an aqueous (deionized water) solution of HCl (and emulsifier for Run No. 6) at 60° C. while stirring with a Premier mixer connected to a variac for control of motor speed. The melt of softening active compounds was added slowly in three equal increments. $CaCl_2$ solution was added into-the hot dispersions which were allowed to cool to room temperature slowly with stirring. During cooling, a few drops of Dow Corning 1430 antifoam was added.

The viscosity and other properties are shown in the following Table 2.

TABLE 2

| Physical Properties | COMPOSITION #1 | #2 | #3 | #4 | #5 | #6 |
|---|---|---|---|---|---|---|
| Comments | — | Softening Efficacy = 24 EQ | — | — | Softening Efficacy = 35 EQ (see Note 2) | Softening Efficacy = 32 EQ |
| Average Particle Size (μm) | — | 5.88 | — | — | 1.69 | 2.27 |
| pH | 0.4 | 0.55 | 0.45 | 0.71 | 0.75 | 0.75 |
| Viscosity, cps 20 rpm | spindle 4 | spindle 4 | spindle 4 | spindle 4 | spindle 4 (see Note 1) | spindle 4 |
| Initial | 90 | 250 | 850 | 1190 | 820 | 1370 |
| Day 1 | 70 | — | 1200 | 1290 | 850 | — |
| Week 1 | 70 | 190 | | | 530 | |
| Week 2 | 100 | 230 | 960 | | | |
| Week 3 | 120 | | 780 | | | |
| Week 10 | 140 | 250 (week 9) | 640 | | 430 | 1040 (week 8) |

Note 1. A second sample with the same composition had an initial viscosity of 1260 cps and a 10 week viscosity of 910 cps.
Note 2. A sample diluted to 5% of (A) and (B) combined exhibited a softening efficacy of 5 EQ. EQ values are the softening performance of an equivalent weight of ditallowdimethyl ammonium chloride as described below.

Compositions 1–5 were stable (no phase separation) and low viscosity dispersions of Varisoft-512 and ester quat softeners at up to 34% active level in the presence or absence of an emulsifier. Softening efficacy of the dispersions at full strength (undiluted) or diluted (composition No. 5) were compared with ditallow dimethyl ammonium chloride. The softening efficacy of the dispersion No. 5 at 5% solid level was 5 EQ. Product activity of 1EQ is the softening obtained by 1% dispersion of ditallow dimethyl ammonium. chloride. The undiluted dispersions 1–6 under similar conditions exhibited a product activity of 20 EQ. The softening efficacy of composition #6 was 5 EQ at 5% use level and was 35 EQ for the undiluted 34% actives composition. The softening corresponding to 5% level of ditallow dimethylammonium chloride (DTDMAC) is referred as 5EQ and at double dosage level (corresponding to 10% level of DTDMAC) is referred to as 10 EQ. If one plots a graph of softening versus the dosage amount of ditallow dimethylammonium chloride (a standard used for the softening evaluation), the softening increases linearly with the dosage of DTDMAC up to about 9–10% and then it levels off. This means, that for a dispersion of ditallow dimethylammonium chloride (say 5%) comparing the softening efficacy at 15% and 12% dosage levels, one cannot make a distinction in the softening performance. For example, to obtain a diluted composition with a softening efficacy of 10 EQ using a 34% dispersion, a compare can be made with a 5% dispersion of DTDMAC. If "y" grams of the 5% DTDMAC product is used in the test to get a softening efficacy of 5 EQ, then ("y"×10/5) grams would be used to get 10 EQ softening efficacy. The amount of 34% dispersion needed would be equal to [5/34 ("y")] grams. So in general the EQ ratings are obtained at low concentration levels. The softening performance values correlating to a value of for example 35 EQ for the undiluted composition is based on the assumption of linear effect for the amount of softening agent and softening. performance.

EXAMPLE 2

This example further demonstrates the synergistic interaction between components (A) and (B) using a mixture of Varisoft 510 and Varisoft 512.

Compositions Nos. 7–17 were prepared with varying amounts of softening active ingredients (A) and (B) and varying amounts of unsaturated alkyl groups in $R_1$ and $R_2$ of formula (I) of component (A) by varying the amounts and proportions of Varisoft 510 and Varisoft 512 as shown in Table 3. The following procedure was used to prepare these compositions. Varisoft 510, Varisoft 512 and Tetranyl AT-75 (in the amounts shown in Table 3) were each melted, mixed together with stirring and maintained at 70° C. Perfume (Douscent 653, from IFF in the amounts shown in Table 3) was added to the molten mixture just prior to emulsification with the aqueous phase. Separately HCl (in the amounts shown in Table 3) was added to heated (70° C.) deionized water. The mixture of molten softening active compounds was added to the acidified water phase with stirring using a 4-pitched-blade impeller. During addition of the molten mixture the stirring speed was increased from 300 to 700 rpm as the emulsion thickened. Calcium chloride (0.4%, as 20% aqueous solution) was added to break or prevent gelation. The hot mixture was stirred for an additional 10 minutes at 350 rpm and the emulsion was allowed to cool to 30° C. at which time colorant (0.03%) and preservative (0.01%) were added. Milliken Liquitint Royal Blue was used as colorant and KKM446 was used as preservative.

Each of the compositions was measured for initial viscosity, viscosity after storage at 4° C. for 24 hours and, softening performance. The results are reported in Table 3, below.

TABLE 3

| Comp. No. | Total Actives (A) and (B) weight % | Varisoft 510 wt %[1] | Varisoft 512 wt %[1] | Unsaturated Alkyl Groups[2] | Esterquat wt %[1] | HCl % | Perfume % | Brookfield viscosity (cps)[3] initial | Brookfield viscosity (cps)[3] 24 h, 4° C. | Softness EQ |
|---|---|---|---|---|---|---|---|---|---|---|
| 7 | 25 | 100 | 0 | 0 | 0 | 1.1 | 1.2 | 470 | | 25 |
| 8 | 30 | 100 | 0 | 0 | 0 | 1.32 | 1.2 | Gel[4] | | 30 |
| 9 | 22 | 87.5 | 12.5 | 5.6 | 0 | 1.04 | 1.2 | 980 | | 24 |
| 10 | 25 | 87.5 | 12.5 | 5.6 | 0 | 1.18 | 1.2 | Gel | | 28 |
| 11 | 28 | 67 | 0 | 0 | 33 | 0.9 | 2.4 | 87 | Gel | 40 |
| 12 | 31.5 | 67 | 0 | 0 | 33 | 1.01 | 2.7 | 166 | Gel | 45 |
| 13 | 35 | 67 | 0 | 0 | 33 | 1.12 | 3 | Gel | | 50 |
| 14 | 28 | 46 | 16.7 | 11.2 | 37.5 | 0.84 | 2.4 | 128 | 128 | 40 |
| 15 | 31.5 | 46.8 | 16.7 | 11.2 | 37.5 | 0.95 | 2.4 | 120 | 94 | 45 |
| 16 | 35 | 46.8 | 16.7 | 11.2 | 39.5 | 1.05 | 2.4 | 240 | 200 | 50 |
| 17 | 38.5 | 46.8 | 16.7 | 11.2 | 37.5 | 1.16 | 2.4 | Gel | | 55 |

[1]Proportion of Varisoft 510, Varisoft 512 and esterquat based on the total actives (A) + (B) combined
[2]Based on total of $R_1$ and $R_2$ groups in Varisoft 510 and Varisoft 512
[3]Measured with Brookfield model DV-II viscometer, Spindle #2, 50 rpm, at Room Temperature
[4]Gel, viscosity greater than 8,000 cps Considering Composition No. 17 which formed a gel, by increasing the amount of electrolyte, or increasing the amount of Varisoft 512 relative to Varisoft 510, the viscosity can be reduced to acceptable (for pourability) levels.

Thus, according to the present invention it is possible to provide aqueous dispersions containing more than 25% of total active softening compounds and which provide enhanced softening performance yet are easily pourable and remain stable over extended periods of time.

Having described the invention including several embodiments thereof it will be readily apparent to the skilled practitioner that other modifications and variations are also within the scope and spirit of the invention and that the foregoing examples are given for purposes of illustration only, and not by way of limitation.

What is claimed:

1. A stable, pourable and water dispersible fabric softener composition comprising an aqueous dispersion containing particles from about 0.01 μm to about 25 μm of about 28 to about 50 weight percent of the total formulation of components (A) and (B) combined, with the proviso that at least 20% of hydrocarbon groups in components (A) and (B) contain unsaturated carbon to carbon bonds, wherein:

(A) a is an inorganic or organic acid salt of a fabric softening compound of formula (I):

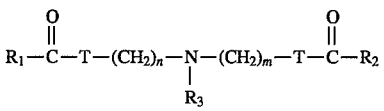

(I)

wherein $R_1$ and $R_2$, independently, represent $C_{12}$ to $C_{30}$ aliphatic hydrocarbon groups, $R_3$ represents $(CH_2CH_2O)_pH$, $CH_3$ or H, T represents NH, n=1to 5, m=1 to 5, and p=1 to 10;

(B) is a biodegradable fatty ester quaternary ammonium compound of formula (11):

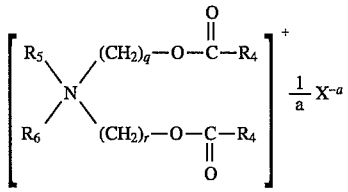

(II)

wherein each $R_4$ independently represents an aphatic hydrocarbon group having from to 8 to 22 carbon atoms, $R_5$ represents $(CH_2)_sR_7$ (where $R_7$ represents an alkoxy carbonyl group containing from 8 to 22 carbon atoms, benzyl, phenyl, $(C_1–C_4)$-alkyl substituted phenyl, OH or H); $R_6$ represents $(CH_2)_tR_8$ (where $R_8$ represents benzyl, phenyl $(C_1–C_4)$ alkyl substituted phenyl, OH or H); q, r, s and t, each independently, represent a number of 1 to 3; and x is an anton of valence a; and (C) an aqueous solvent including an anti-gelling effective amount of electrolyte;

(D) the weight ratio of formula (I) to formula (II) is from about 5:1 to about 1:5; and (E) wherein the composition has a viscosity of less than 2,000centipoise at 20° C.

2. The fabric softener composition of claim 1 wherein in the compound of formula (I), $R_1$ and $R_2$=$C_{16}$ to $C_{22}$ alkyl or alkenyl;

m=1 to 3; n=1 to 3;

$R_3$=$(CH_2CH_2O)_pH$; and p=1.5 to 3.5.

3. The composition of claim 1 wherein the total unsaturation being less than 70% of the combined weight of (A) and (B).

4. The composition of claim 3 wherein the total amount of (A) and (B) ranges from about 28% to about 38% by weight based on the total composition.

5. The composition of claim 1 wherein the total amount of (A) and (B) ranges from about 28 to 38% by weight based on the total composition.

6. The composition of claim 1 wherein the weight ratio of (A):(B) is in the range of from about 2:1 to 1:2 and the total unsaturation being less than 70% of the combined weight of (A) and (B).

7. The composition of claim 6 wherein the total amount of (A) and (B) is in the range of from about 28 to about 38% by weight.

8. The composition of claim 1 wherein the compound (A) fabric softener contains no more than about 65% of hydrocarbon groups with carbon to carbon bond unsaturation.

9. The composition of claim 8 wherein the total amount of hydrocarbon groups with unsaturated carbon to carbon double bonds in $R_1$ and $R_2$ of formula (I) is in the range of from about 2.4% to about 50% by weight.

10. The composition of claim 1 wherein the aqueous solvent comprises water and from about 0.05% up to about 2.0%, by weight of an alkaline earth metal salt electrolyte.

11. The fabric softening composition of claim 10 which has a viscosity at 25° C. of less than 1000 cps.

12. The fabric softening composition of claim 1 which comprises:

(A) from about 10 to about 25% by weight of a mixture of salts of bis(tallowamidoethyl)-2-hydroxyethylamine) and bis(hydrogenated tallow amidoethyl)-2-hydroxyethyl amine; at least 30% and up to about 65% by weight of the tallow being unsaturated;

(B) from about 10 to 18% by weight of N-methyl-N,N,N-triethanolamine ditallowester quaternary ammonium methosulfate; with a total amount of (A) and (B) combined of from 28 to 38% by weight;

(C) from about 0.05 to 2.0% inorganic salt electrolyte, said composition having a viscosity of no more than about 1500 cps at 25° C.

13. A method of imparting softness to fabrics comprising contacting the fabrics with a softening effective amount of the fabric softener composition of claim 1.

14. The method of claim 13 wherein said contacting is in the rinse cycle of an automatic laundry washing machine.

* * * * *